US012624538B2

(12) United States Patent
Liu

(10) Patent No.: US 12,624,538 B2
(45) Date of Patent: May 12, 2026

(54) DISSOLVER FOR CLEANING TABLET IN WATER TANK OF TOILET

(71) Applicant: LAB (XIAMEN) SANITARY FITTINGS INC., Xiamen (CN)

(72) Inventor: Yongmao Liu, Xiamen (CN)

(73) Assignee: LAB (XIAMEN) SANITARY FITTINGS INC., Xiamen (CN)

( * ) Notice: Subject to any disclaimer, the term of this patent is extended or adjusted under 35 U.S.C. 154(b) by 100 days.

(21) Appl. No.: 18/432,388

(22) Filed: Feb. 5, 2024

(65) Prior Publication Data

US 2025/0179785 A1 Jun. 5, 2025

(30) Foreign Application Priority Data

Nov. 30, 2023 (CN) ..... 202323279650.8

(51) Int. Cl.
*E03D 9/03* (2006.01)
*E03D 9/02* (2006.01)

(52) U.S. Cl.
CPC ..... *E03D 9/038* (2013.01); *E03D 2009/024* (2013.01)

(58) Field of Classification Search
CPC ..... E03D 9/038; E03D 2009/024
USPC ..... 4/227.1
See application file for complete search history.

(56) References Cited

U.S. PATENT DOCUMENTS 5,815,850 A * 10/1998 Shon ..... E03D 9/02 4/225.1
6,151,722 A * 11/2000 Lubrano ..... E03D 9/037 4/225.1
8,925,119 B2 * 1/2015 Burt ..... E03D 9/037 4/225.1
11,821,189 B1 * 11/2023 Stanfield ..... E03D 9/038

FOREIGN PATENT DOCUMENTS

EP 1466056 B1 5/2008

* cited by examiner

*Primary Examiner* — Huyen D Le
(74) *Attorney, Agent, or Firm* — COOPER LEGAL GROUP LLC

(57) ABSTRACT

A dissolver for a cleaning tablet in a water tank of a toilet includes a dissolver body arranged on a water piece inside the water tank of the toilet, where a dissolving cavity for storing and dissolving the cleaning tablet is arranged inside the dissolver body; the dissolver body is further provided with a water inlet and a water outlet which communicate with the dissolving cavity; the water inlet is connected to a water replenishing tube of a water inlet valve; the water outlet is connected to an overflow tube of a water outlet valve; and when the water inlet valve replenishes water, the water in the water replenishing tube flows into the dissolving cavity from the water inlet to dissolve the cleaning tablet, and the water after the cleaning tablet is dissolved flows into the overflow tube from the water outlet to replenish the water for the toilet.

16 Claims, 15 Drawing Sheets

DISSOLVER FOR CLEANING TABLET IN WATER TANK OF TOILET

CROSS-REFERENCE TO RELATED APPLICATIONS

This application claims priority to Chinese Patent Application 202323279650.8, filed on Nov. 30, 2023, which is incorporated herein by reference.

TECHNICAL FIELD

The present disclosure relates to the field of toilet cleaning technologies, in particular to a dissolver for a cleaning tablet in a water tank of a toilet.

BACKGROUND

The cleaning tablet in a water tank of a toilet is a cleaning tablet for cleaning the interiors of the toilet and the water tank. Generally, the cleaning tablet is directly put into the water tank for use. The cleaning tablet will be continuously dissolved after being put into the water tank until it is completely dissolved, thereby shortening the usage time. If the toilet is not used for a long time, the solubility of a cleaning agent in the water tank will be increased, such that a water piece in the water tank is easily damaged. Moreover, the cleaning tablet easily flows back into a domestic water pipeline from an anti-siphon gap of a water inlet valve, resulting in pollution of domestic water.

A distributor system for cleaning a toilet and a detachable ink cartridge are disclosed in the patent No. EP1466056B1. In this patent, a distributor system for placing a cleaning tablet is provided. The distributor system is connected to a water replenishing tube of a water inlet valve and an overflow tube through pipelines. When the water inlet valve replenishes water for the toilet, the water flows into the distributor system from the water replenishing tube to dissolve the cleaning tablet, and the water after the cleaning tablet is dissolved flows into a trap of the toilet from the overflow tube to replenish the water. According to the distributor system, the cleaning tablet is dissolved and consumed only when the water inlet valve replenishes the water, thereby solving the problems that the cleaning tablet has a short usage time and easily flows back through an anti-siphon gap. However, the distributor system has the following defects:

1. The distributor system is hung on the side wall of a water tank through a hook type hanging bracket which extends from the water tank to the outer wall of the water tank, such that a lid of the water tank is difficult to close tightly to affect the sealing performance of the water tank, and is inconvenient and laborious to mount.
2. In the distributor system, a barrel apparatus for storing the cleaning tablet is cylindrical. Because a plurality of water collector structures are arranged inside the distributor system, the size of the barrel apparatus is limited. A barrel-shaped space inside the barrel apparatus has small diameter, thus limiting the shape and size of the cleaning tablet that can be stored. Generally, all cleaning tablets commonly known as "Smurfs" on the market cannot be put into the barrel apparatus which can only be suitable for cleaning tablets matched therewith, resulting in poor applicability and incapability of meeting the requirements of more customers.

3. The distributor system has a complex structure and high cost, and requires a long pipeline to be connected to the water inlet valve and the overflow tube, thus occupying a large space.

SUMMARY

An objective of the present disclosure is to provide a dissolver for a cleaning tablet in a water tank of a toilet, which is mounted on a water piece inside the water tank without affecting the closing tightness of a tank lid, and is suitable for cleaning tablets with various sizes and shapes, thereby having high applicability, a simple structure, and low cost.

To achieve the above objective, the present disclosure adopts the following technical solution: a dissolver for a cleaning tablet in a water tank of a toilet includes a dissolver body arranged on a water piece inside the water tank of the toilet, where a dissolving cavity for storing and dissolving the cleaning tablet is arranged inside the dissolver body; the dissolver body is further provided with a water inlet and a water outlet which communicate with the dissolving cavity; the water inlet is connected to a water replenishing tube of a water inlet valve; the water outlet is connected to an overflow tube of a water outlet valve; and when the water inlet valve replenishes water, the water in the water replenishing tube flows into the dissolving cavity from the water inlet to dissolve the cleaning tablet, and the water after the cleaning tablet is dissolved flows into the overflow tube from the water outlet to replenish the water for the toilet.

Further, the dissolver body is hung on the overflow tube; the water outlet communicates with the overflow tube; and the water inlet is connected to the water replenishing tube of the water inlet valve through a pipeline.

Further, an arc-shaped groove matched with a side wall of the overflow tube is provided in a bottom of a side wall of the dissolver body; the dissolver body is hung at a top of the overflow tube through matching between the arc-shaped groove and the side wall of the overflow tube; the water outlet is provided in the side wall of the dissolver body and located above the arc-shaped groove; the dissolver body is provided with a water outlet channel extending downwards at the water outlet; and when the dissolver body is hung at the top of the overflow tube, the water outlet channel extends into the overflow tube.

Further, a partition board is arranged inside the dissolving cavity of the dissolver body; one end of the partition board is integrally connected to a side wall of the dissolving cavity; a gap is reserved between the other end of the partition board and the side wall of the dissolving cavity; the water inlet and the water outlet are located on one side of the partition board; and the cleaning tablet is located on the other side of the partition board.

Further, a connecting sleeve is arranged at a bottom of the dissolver body and sleeved on the overflow tube.

Further, a first water passing hole is provided in a top of the connecting sleeve; and the water outlet is provided in the bottom of the dissolver body and corresponds to the first water passing hole.

Further, a boss is convexly arranged at a position, corresponding to the water outlet, of a bottom of the dissolving cavity; and a second water passing hole communicating with the water outlet is provided in a side wall of the boss.

Further, the dissolver body is arranged on the water inlet valve; the water inlet is inserted with the water replenishing tube of the water inlet valve; and the water outlet is connected to the overflow tube through a pipeline.

Further, the dissolver body is provided with a water inlet connector at the water inlet; and the water inlet connector is matched with the water replenishing tube of the water inlet valve in an inserted manner.

Further, the water inlet connector connected to the water replenishing tube of the water inlet valve is arranged at the water inlet of the dissolver body; and a water replenishing regulator is arranged on the water inlet connector and configured to regulate water flow entering the dissolving cavity.

With the above solution, the present disclosure has the following beneficial effects:

1. According to the present disclosure, the dissolver body is arranged on various water pieces inside the water tank of the toilet, for example, the dissolver body may be hung on the overflow tube of the water outlet valve or the water inlet valve, such that a hook type hanging bracket does not need to be arranged, the problem of difficulty in tightly closing a lid of the water tank is avoided, and the lid of the water tank is easy to mount.
2. According to the present disclosure, the dissolving cavity for storing and dissolving the cleaning tablet is provided inside the dissolver body, and the cleaning tablet is placed in the dissolving cavity, is not in contact with the water in the water tank, and thus does not flow back into a domestic water pipeline from an anti-siphon gap of the water inlet valve, thereby avoiding pollution of domestic water. Moreover, only when the water inlet valve replenishes water, the water flows into the dissolving cavity from the water replenishing tube to dissolve the cleaning tablet, and the water after the cleaning tablet is dissolved flows into the overflow tube from the water outlet and then flows into a trap of the toilet to replenish the water for the toilet, such that the cleaning tablet is dissolved only when the water inlet valve replenishes the water, thereby prolonging the usage time. In addition, a size and a shape of the dissolving cavity are not limited and may be set as needed, such that cleaning tablets with various shapes and sizes may be placed. Therefore, the dissolver has high applicability and meets the requirements of more customers.
3. According to the present disclosure, only a dissolving cavity may be provided inside the dissolver body, such that the dissolver has a simple structure and low cost. Moreover, the dissolver body may be hung on the water inlet valve and the overflow tube of the water outlet valve, and the water inlet may directly communicate with the water replenishing tube of the water inlet valve, or the water outlet directly communicates with the overflow tube, thereby reducing the arrangement of pipelines and occupied spaces, and further reducing costs.

DESCRIPTION OF REFERENCE NUMERALS

Figure 1:
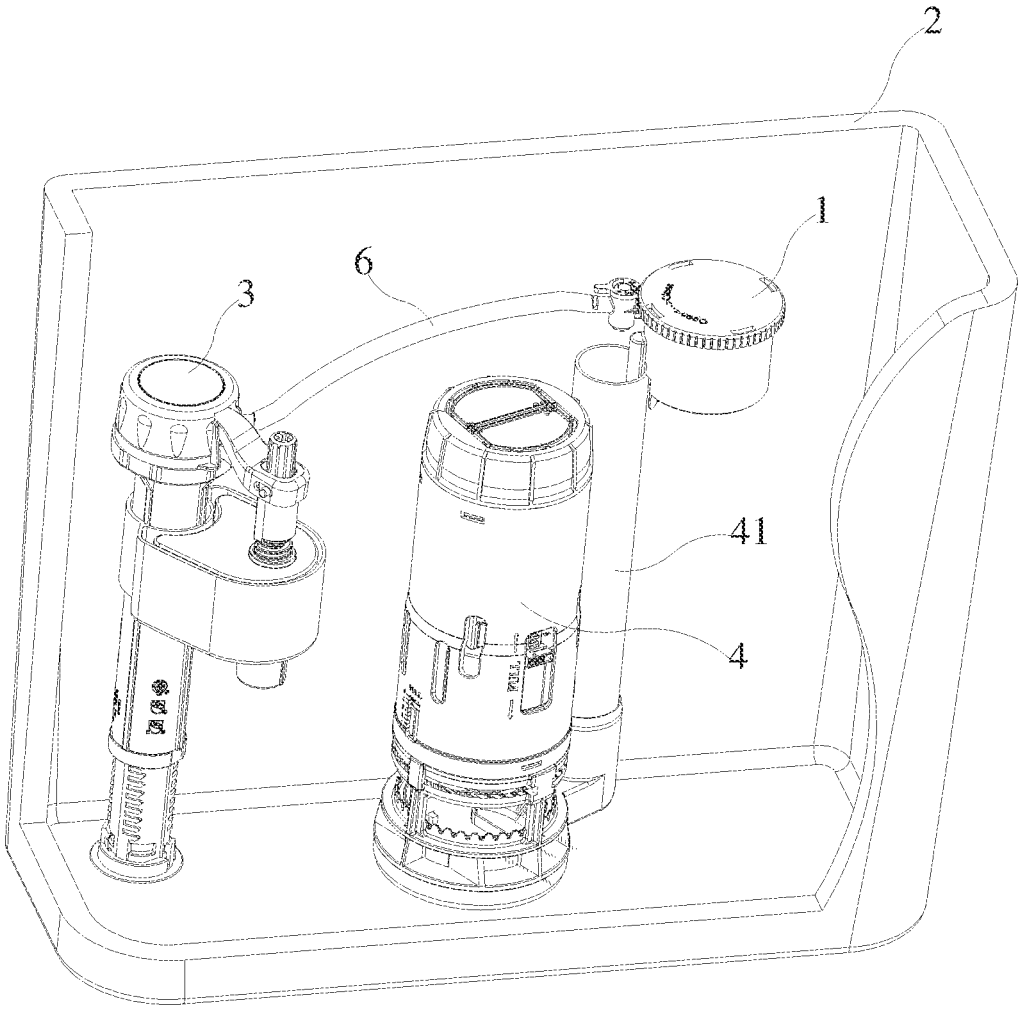
FIG. 1 is a schematic diagram of a structure of a dissolver body mounted on an overflow tube in Embodiment 1 of the present disclosure.
Figure 2:
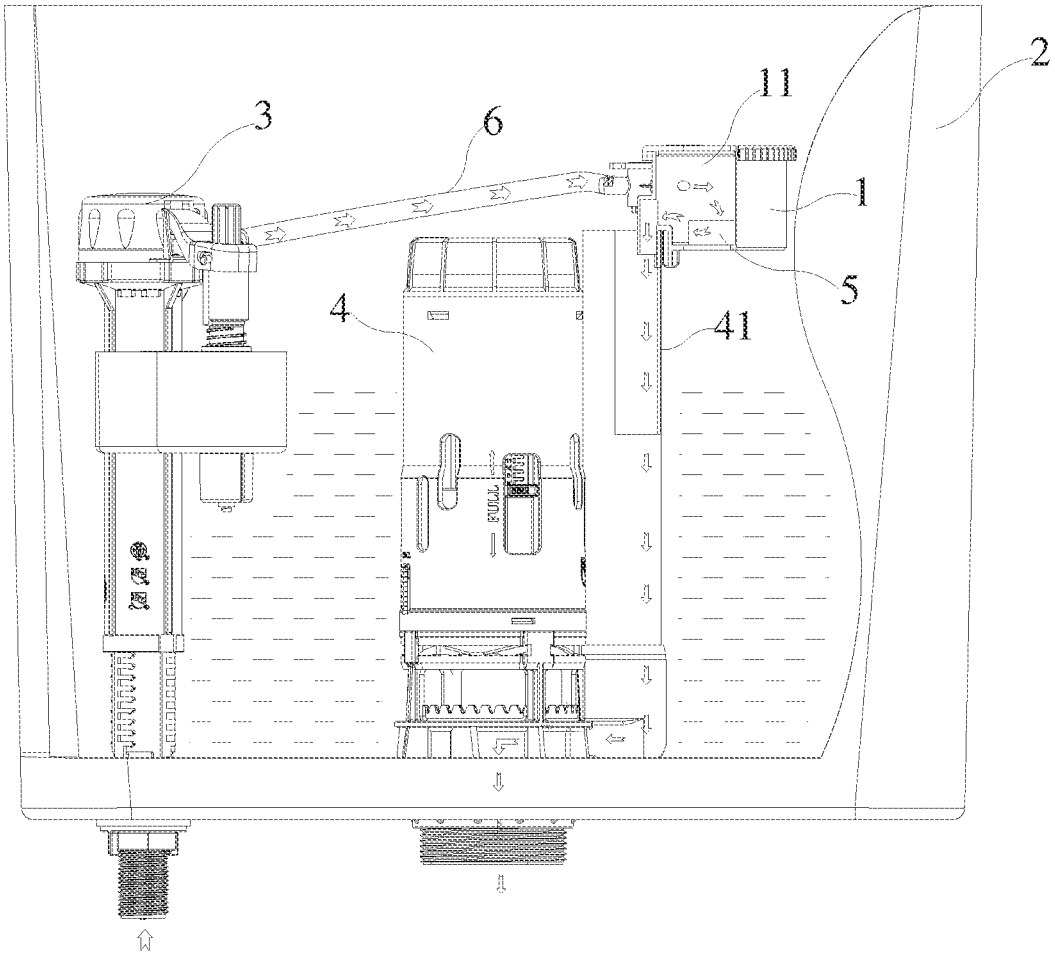
FIG. 2 is a schematic diagram of a flow path of a dissolver body mounted on an overflow tube in Embodiment 1 of the present disclosure.

1. dissolver body; 11. dissolving cavity; 111. partition board; 112. boss; 113. second water passing hole; 12. water inlet; 13. water outlet; 14. cover; 15. arc-shaped groove; 16. water outlet channel; 17. water inlet connector; 171. water replenishing regulator; 18. arc-shaped bulge; 19. water outlet connector; 2. water tank; 3. water inlet valve; 31. water replenishing tube; 4. water outlet valve; 41. overflow tube; 5. cleaning tablet; 6. pipeline; 7. connecting sleeve; 71. first water passing hole; and 8. supports.

DESCRIPTION OF EMBODIMENTS

The present disclosure is described in detail below with reference to the accompanying drawings and specific embodiments.

As shown in FIGS. 1 to 19, the present disclosure provides a dissolver for a cleaning tablet in a water tank of a toilet, including a dissolver body 1 arranged on a water piece inside the water tank 2 of the toilet, where the water piece inside the water tank 2 of the toilet includes a water inlet valve 3, a water outlet valve 4, and other tank components. The dissolver body 1 may be mounted on any water piece as needed, such that a hook type hanging bracket does not need to be arranged to hang the dissolver body on a side wall of the water tank 2, the problem of difficulty in tightly closing a lid of the water tank 2 is avoided, and the lid of the water tank 2 is easy to mount. A dissolving cavity 11 for storing and dissolving the cleaning tablet 5 is provided inside the dissolver body 1, and the cleaning tablet 5 is placed in the dissolving cavity 11, is not in contact with water in the water tank 2, and thus does not flow back into a domestic water pipeline 6 from an anti-siphon gap of the water inlet valve 3, thereby avoiding pollution of domestic water. Moreover, only one cavity structure of the dissolving cavity 11 is provided inside the dissolver body 1, and a size and a shape of the dissolving cavity 11 are not limited and may be set as needed, such that the dissolving cavity may be in a cylindrical shape with a large diameter, a cubic box shape, or other shapes. The dissolving cavity has a large space and thus is capable of placing cleaning tablets 5 with various shapes and sizes. Therefore, the dissolver has high applicability and meets the requirements of more customers.

The dissolver body 1 is further provided with a water inlet 12 and a water outlet 13 which communicate with the dissolving cavity 11, the water inlet 12 is connected to a water replenishing tube 31 of the water inlet valve 3, and the water outlet 13 is connected to an overflow tube 41. When the water inlet valve 3 replenishes water, that is, after the water outlet valve 4 drains water, the water inlet valve 3 replenishes the water for a trap (not shown in figure) of the toilet through the water replenishing tube 31 and the overflow tube 41 while replenishing the water for the water tank 2, the water in the water replenishing tube 31 flows into the dissolving cavity 11 from the water inlet 12 to dissolve the cleaning tablet 5, the water after the cleaning tablet 5 is dissolved flows into the overflow tube 41 from the water outlet 13 and finally flows into the trap of the toilet to replenish the water for the toilet, such that the cleaning tablet 5 is dissolved only when the water inlet valve 3 replenishes the water. When the water inlet valve 3 does not replenish the water, that is, the toilet is not used, the cleaning tablet 5 is not dissolved, thereby prolonging the usage time of the cleaning tablet 5, and avoiding the waste and damage of the water piece in the water tank 2.

A detachable cover 14 is arranged at a top of the dissolver body 1. After the cleaning tablet 5 is used up, the cover 14 is detached to add the cleaning tablet 5 again. The dissolver body 1 in the present disclosure has a simple structure and is convenient to use.

A specific structure and a mounting way of the dissolver body 1 are further described below through specific embodiments.

Embodiment 1

Referring to FIGS. 1 to 9, the dissolver body 1 is arranged on the water outlet valve 4 and specifically may be hung on the overflow tube 41 of the water outlet valve 4, and the water outlet 13 directly communicates with the overflow tube 41. The pipeline 6 does not need to be arranged between the water outlet 13 and the overflow tube 41, and only needs to be arranged between the water inlet 12 and the water replenishing tube 31 of the water inlet valve 3 to connect the water inlet 12 to the water replenishing tube 31.

Figure 3:
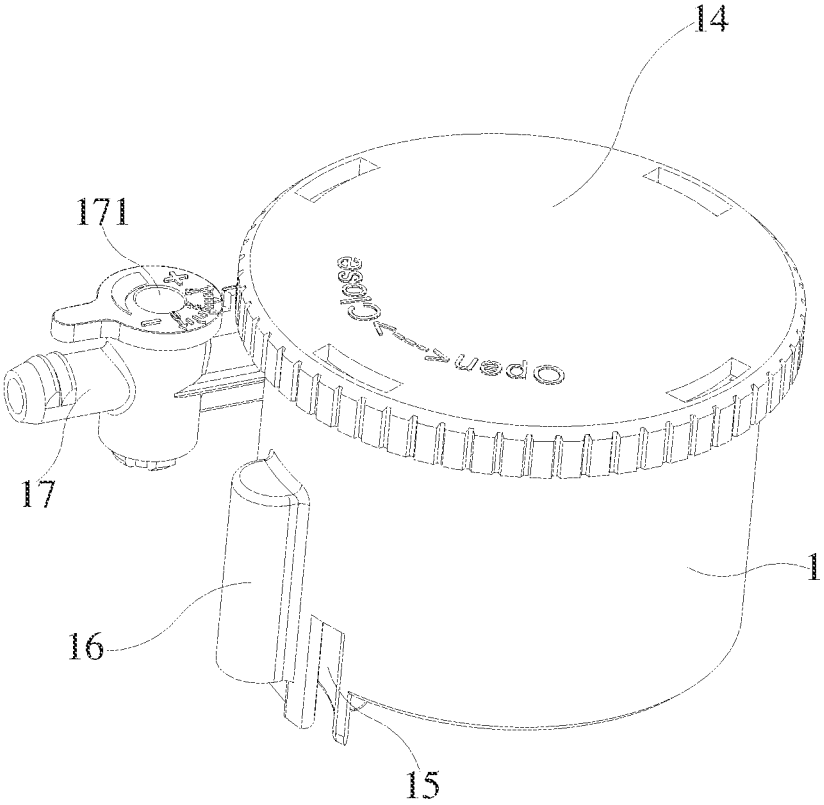
FIG. 3 is a first three-dimensional view of a dissolver body in Embodiment 1 of the present disclosure.
Figure 4:
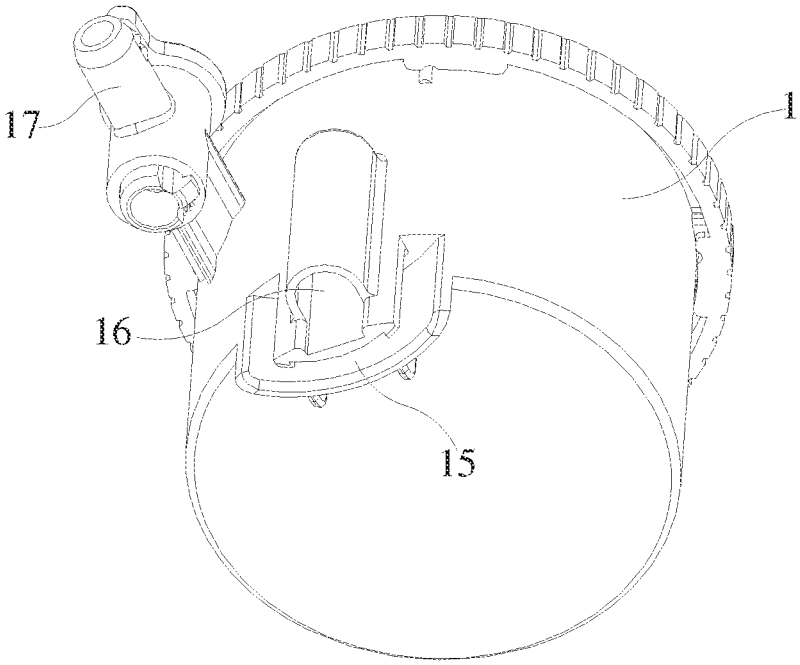
FIG. 4 is a second three-dimensional view of a dissolver body in Embodiment 1 of the present disclosure.
Figure 5:
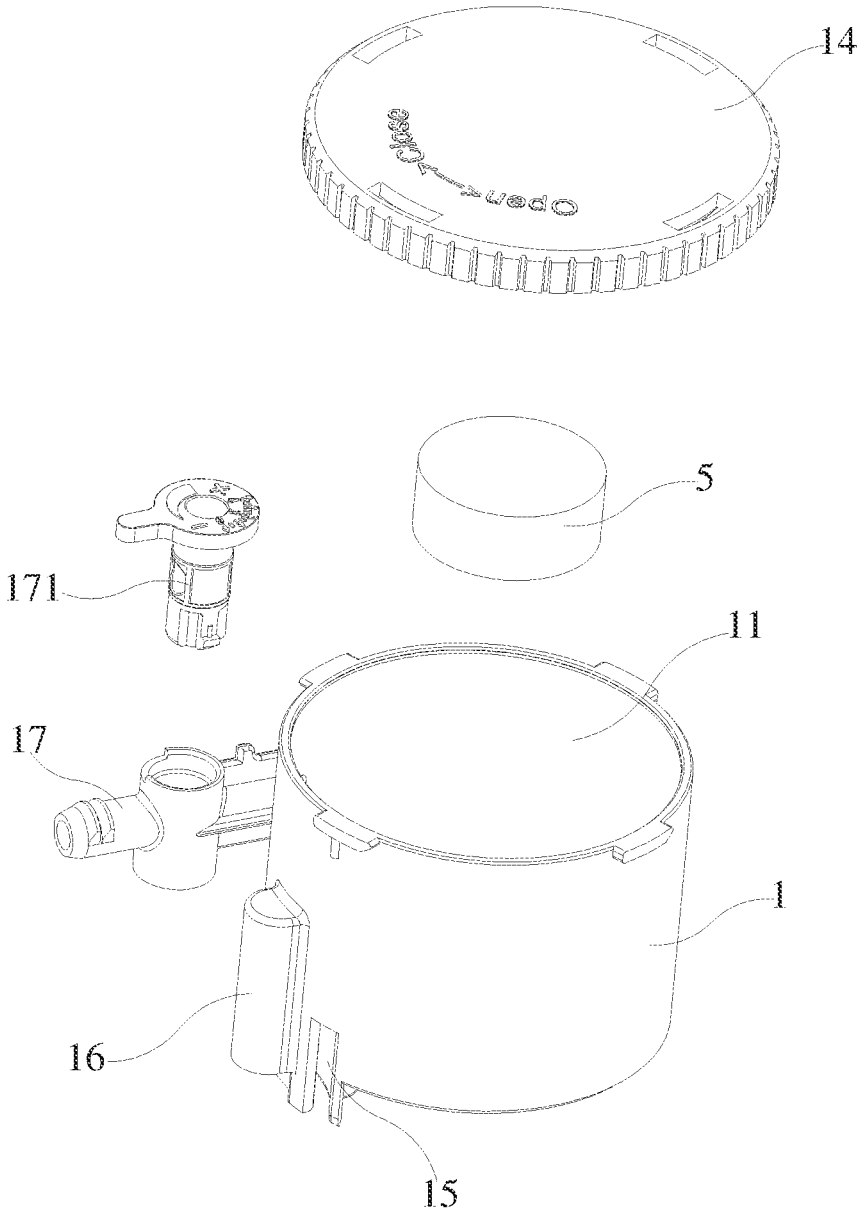
FIG. 5 is an exploded view of a dissolver body in Embodiment 1 of the present disclosure.

Emphatically referring to FIG. 3 and FIG. 4, specifically, the overflow tube 41 is generally in the shape of a circular tube and has an arc-shaped side wall, and an arc-shaped groove 15 matched with the side wall of the overflow tube 41 is provided in a bottom of the dissolver body 1. The arc-shaped groove 15 is aligned with the side wall of the overflow tube 41 and pressed down to enable the side wall of the overflow tube 41 to be embedded into the arc-shaped groove 15, such that the dissolver body 1 may be hung at a top of the overflow tube 41. The dissolver body 1 may be disassembled by pulling up the dissolver body 1, making the disassembly and assembly very convenient.

The water inlet 12 is provided in a side wall of the dissolver body 1, and the water outlet 13 is located below the water inlet 12 to prevent backflow. The arc-shaped groove 15 is preferably provided in a bottom of the side wall of the dissolver body 1 and located below the water outlet 13, such that the dissolver body 1 is eccentrically hung on the overflow tube 41 without blocking an overflow hole in the top of the overflow tube 41. One clamping piece structure may be formed on the side wall and the bottom of the dissolver body 1 and even on two sides of the arc-shaped groove 15 in a downward extension manner. The clamping piece structure is capable of clamping the side wall of the overflow tube 41 to make the dissolver body 1 more stable to mount.

Figure 8:
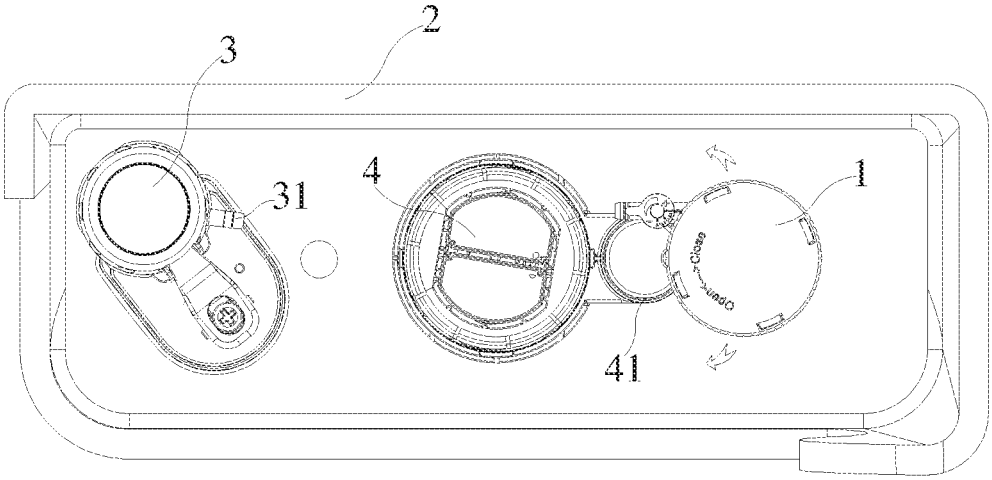
FIG. 8 is a top view of a dissolver body mounted on an overflow tube in Embodiment 1 of the present disclosure.
Figure 9:
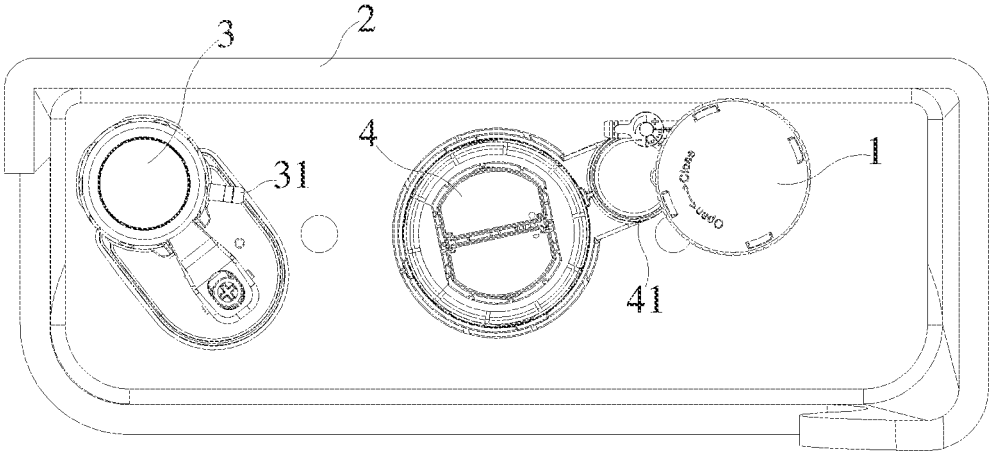
FIG. 9 is a top view of a dissolver body mounted sideways on an overflow tube in Embodiment 1 of the present disclosure.
Figure 10:
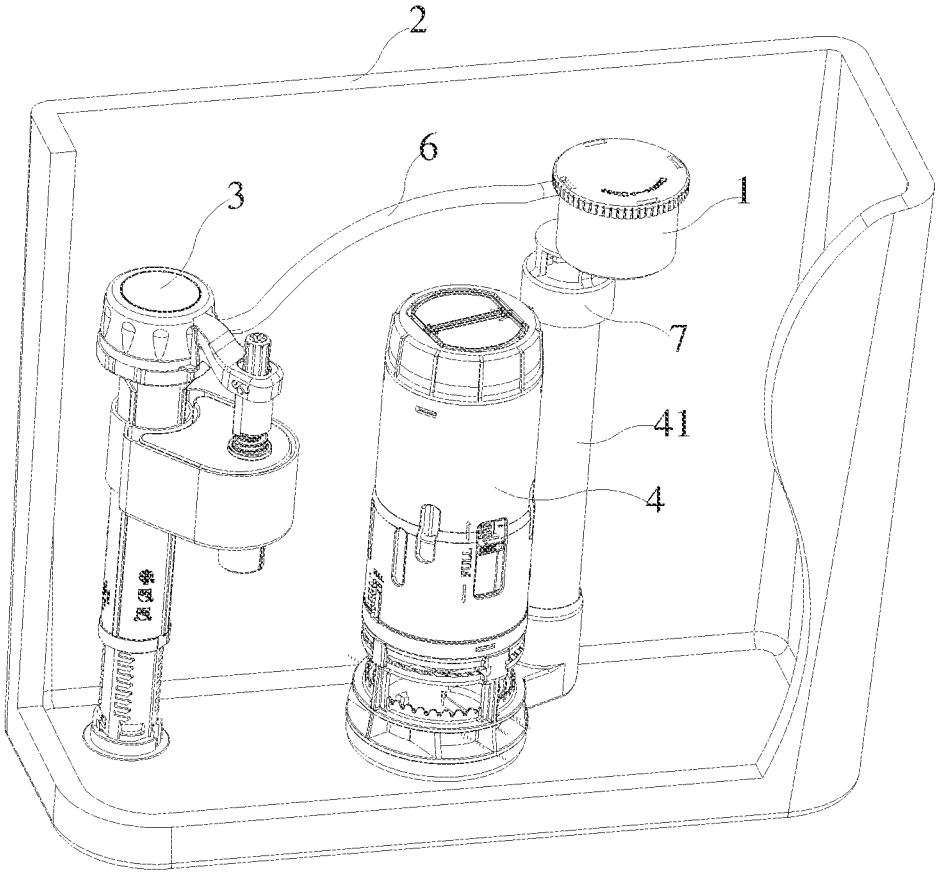
FIG. 10 is a schematic diagram of a structure of a dissolver body mounted on an overflow tube in Embodiment 2 of the present disclosure.
Figure 11:
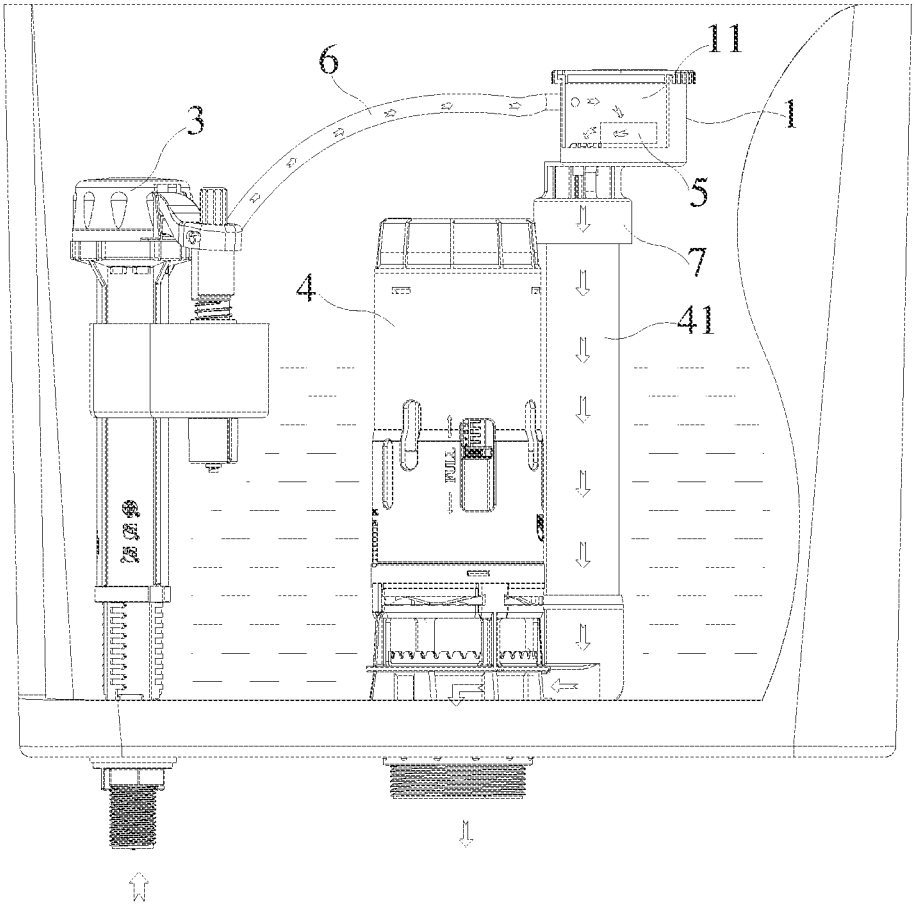
FIG. 11 is a schematic diagram of a flow path of a dissolver body mounted on an overflow tube in Embodiment 2 of the present disclosure.
Figure 12:
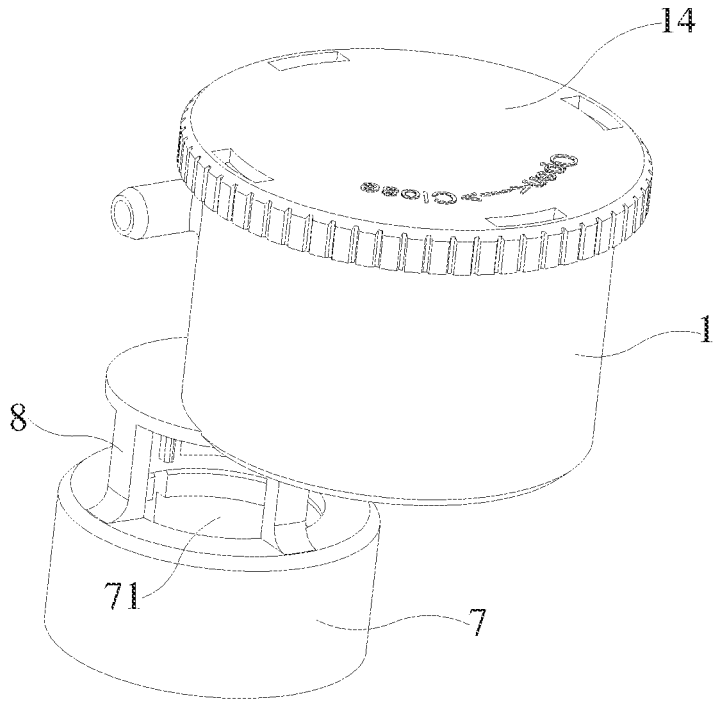
FIG. 12 is a first three-dimensional view of a dissolver body in Embodiment 2 of the present disclosure.
Figure 13:
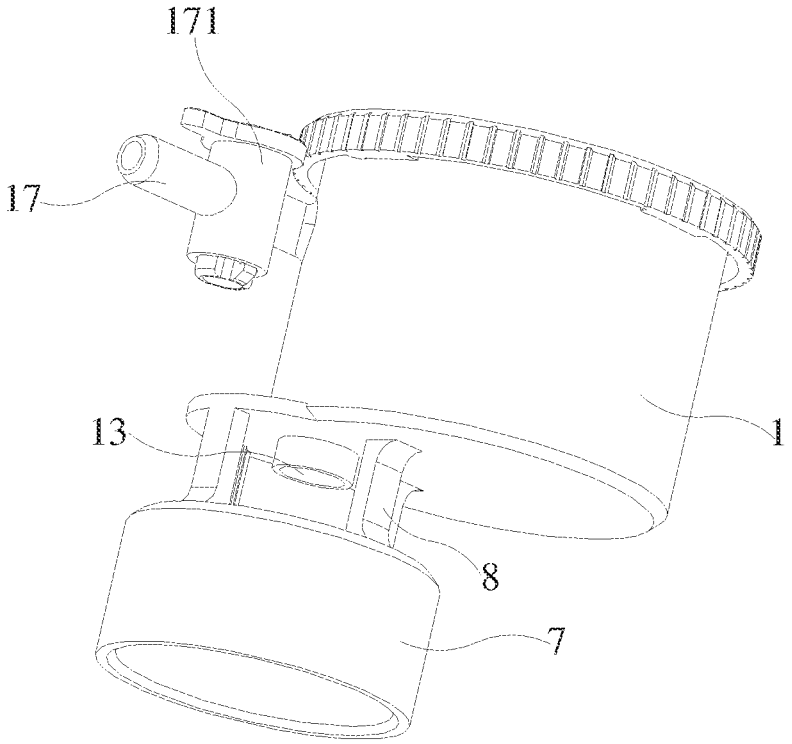
FIG. 13 is a second three-dimensional view of a dissolver body in Embodiment 2 of the present disclosure.

Emphatically referring to FIG. 8 and FIG. 9, the dissolver body 1 is eccentrically hung on the overflow tube 41 and does not interfere with the water outlet valve 4, and a position of the dissolver body 1 is easy to adjust. The dissolver body 1 may be mounted in a middle of the water tank 2 or close to the side wall of the water tank 2.

Figure 6:
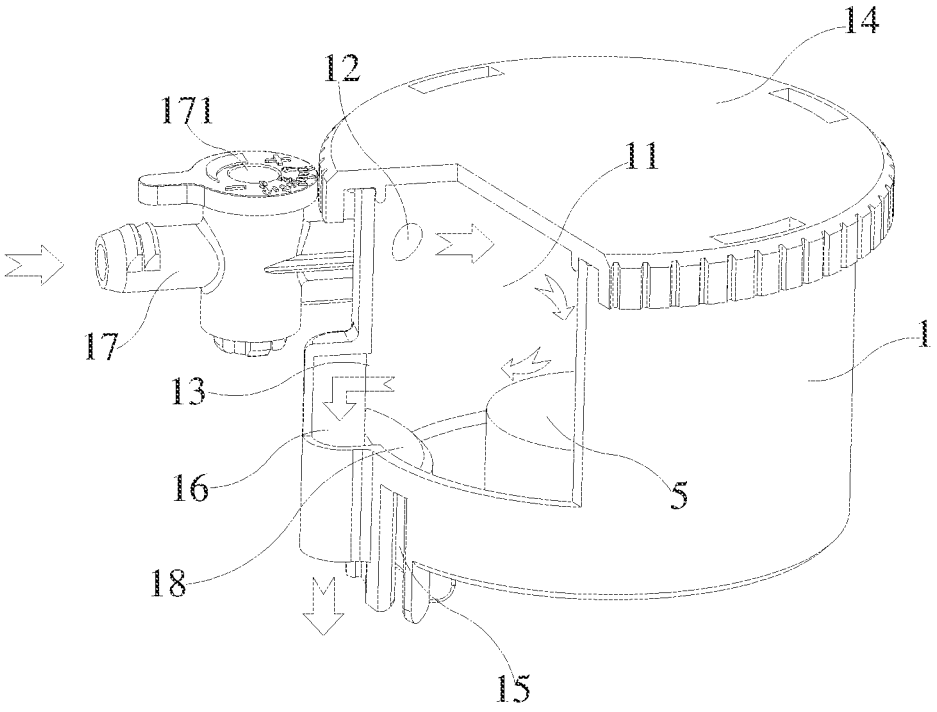
FIG. 6 is a schematic diagram of a flow path of a dissolver body in Embodiment 1 of the present disclosure.

Emphatically referring to FIG. 6, the dissolver body 1 is provided with a water outlet channel 16 extending downwards at the water outlet 13. When the dissolver body 1 is hung at the top of the overflow tube 41, the water outlet channel 16 extends into the overflow tube 41, such that the water outlet 13 directly communicates with the overflow tube 41, and the pipeline 6 does not need to be arranged between the water outlet 13 and the overflow tube 41. The water inlet 12 is connected to the water replenishing tube 31 through the pipeline 6. Specifically, a water inlet connector 17 may be arranged at the water inlet 12 and is connected to the pipeline 6, and a water replenishing regulator 171 may be arranged on the water inlet connector 17 to regulate water flow entering the dissolving cavity 11, thereby preventing the cleaning tablet 5 from being washed by excessive water flow and from being dissolved too fast.

An arc-shaped bulge 18 is formed at a position, corresponding to the arc-shaped groove 15, of a bottom of the dissolving cavity 11. The water outlet 13 is located above the arc-shaped bulge 18. The arc-shaped bulge 18 is capable of preventing the cleaning tablet 5 from blocking the water outlet 13.

Figure 7:
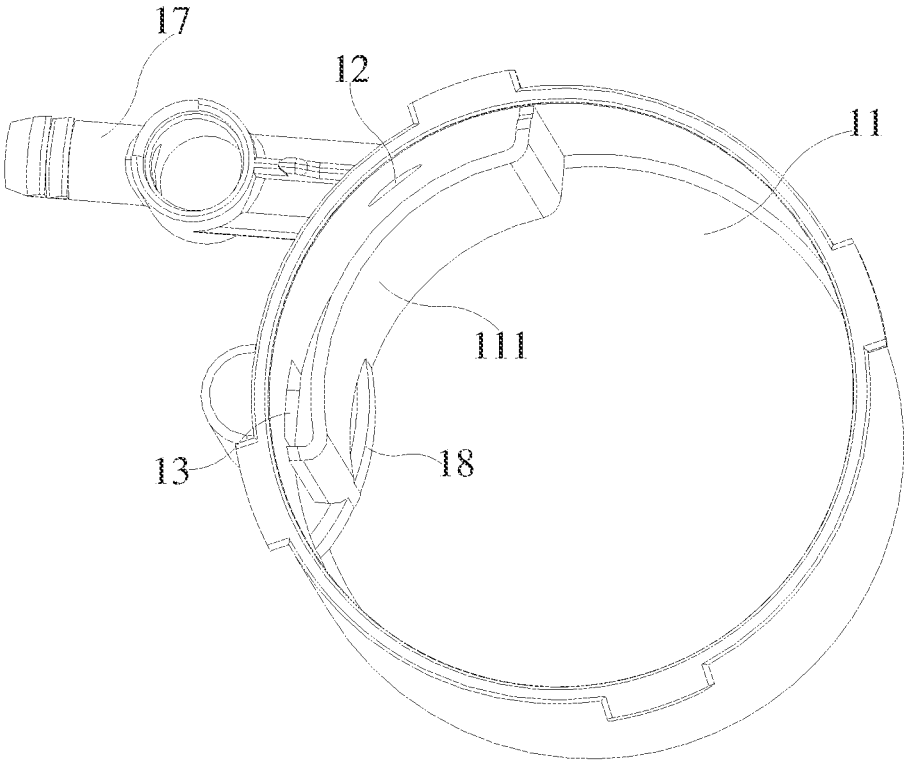
FIG. 7 is a schematic diagram of an internal structure of a dissolver body in Embodiment 1 of the present disclosure.

Emphatically referring to FIG. 7, a partition board 111 is arranged inside the dissolving cavity 11 of the dissolver body 1; one end of the partition board 111 is integrally connected to a side wall of the dissolving cavity 11; a gap is reserved between the other end of the partition board and the side wall of the dissolving cavity 11; the water inlet 12 and the water outlet 13 are located on one side of the partition board 111; and the cleaning tablet 5 is located on the other side of the partition board 111, such that the partition board 111 separates the cleaning tablet 5 from the water inlet 12 and the water outlet 13 to prevent the cleaning tablet 5 from blocking the water outlet 13. The gap between the other end of the partition board 111 and the side wall of the dissolving cavity 11 is a water flow mixing area. The water flows to the cleaning tablet 5 through the gap to dissolve the cleaning tablet 5, and then flows back to the water outlet 13 through the gap to flow out of the dissolving cavity 11, such that the arrangement of the partition board 111 may also prevent the cleaning tablet 5 from being washed by the water flow due to excessive water pressure and from being dissolved too fast, and further prolonging the usage time of the cleaning tablet 5.

Embodiment 2

Referring to FIGS. 10 to 15, the dissolver body 1 in this embodiment is mounted on the overflow tube 41 as in Embodiment 1, but a specific mounting structure is different. In this embodiment, a connecting sleeve 7 is arranged at the bottom of the dissolver body 1 and sleeved at the top of the overflow tube 41, such that the dissolver body 1 can be hung on the overflow tube 41 and is very convenient to disassemble and assemble. Moreover, the dissolver body 1 in this embodiment is hung on the overflow tube 41 as in Embodiment 1. Because the overflow tube 41 is arranged inside each water tank 2 of the toilet and has a standard and common size, this embodiment and Embodiment 1 are suitable to be mounted in various water tanks 2 of toilets, thereby having high adaptability.

Specifically, a first water passing hole 71 is provided in a top of the connecting sleeve 7; and the water outlet 13 is provided in the bottom of the dissolver body 1 and corresponds to the first water passing hole 71. The water after the cleaning tablet 5 is dissolved flows out from the water outlet 13 and then flows into the overflow tube 41 directly from the first water passing hole 71, and the pipeline 6 does not need to be arranged to connect the water outlet 13 to the overflow tube 41. A way of connection between the water inlet 12 and the water replenishing tube 31 in this embodiment is the same as in Embodiment 1.

Further, the connecting sleeve 7 is preferably eccentrically arranged at the bottom of the dissolver body 1 to prevent the dissolver body 1 from blocking the overflow hole in the top of the overflow tube 41. In addition, the connecting sleeve 7 may be connected to the dissolver body 1 through a plurality of supports 8, and the supports 8 increase a distance between the dissolver body 1 and the connecting sleeve 7, thereby further preventing the dissolver body 1 from blocking the overflow hole. If there is too much water in the water tank 2, the water may flow into the first water passing hole 71 from between the adjacent supports 8 and then flow into the overflow tube 41 to flow out of the water tank 2.

Figure 14:
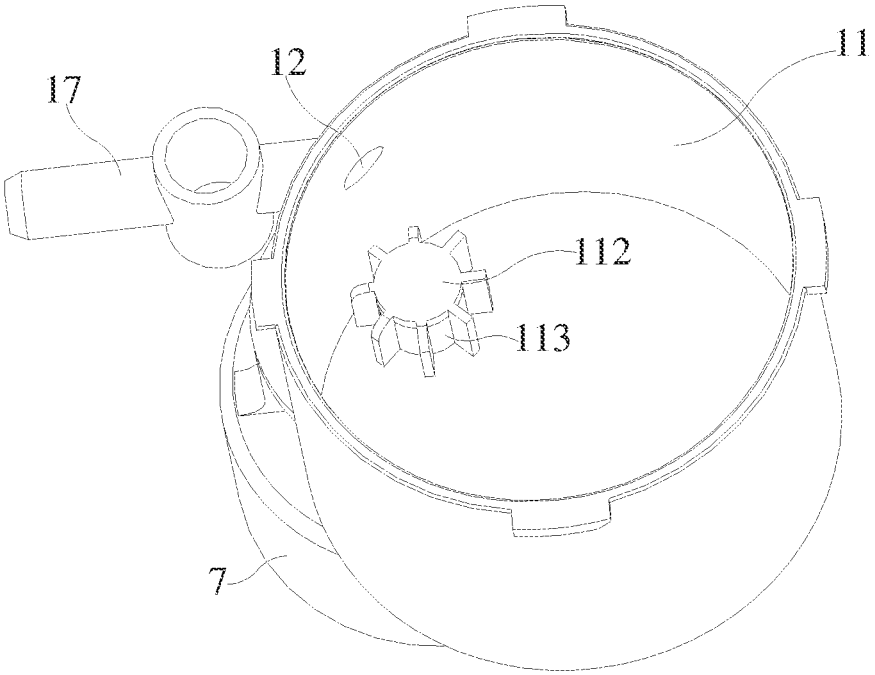
FIG. 14 is a schematic diagram of an internal structure of a dissolver body in Embodiment 2 of the present disclosure.
Figure 15:
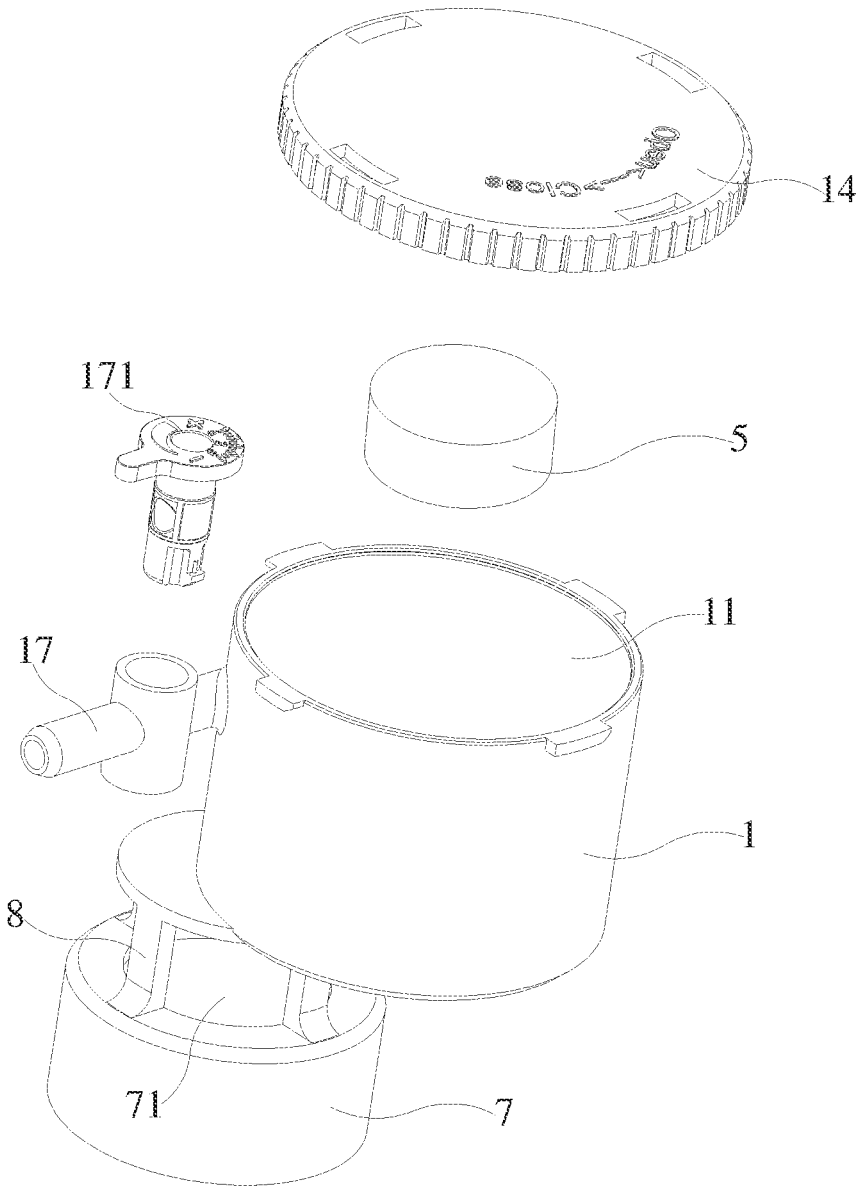
FIG. 15 is an exploded view of a dissolver body in Embodiment 2 of the present disclosure.
Figure 16:
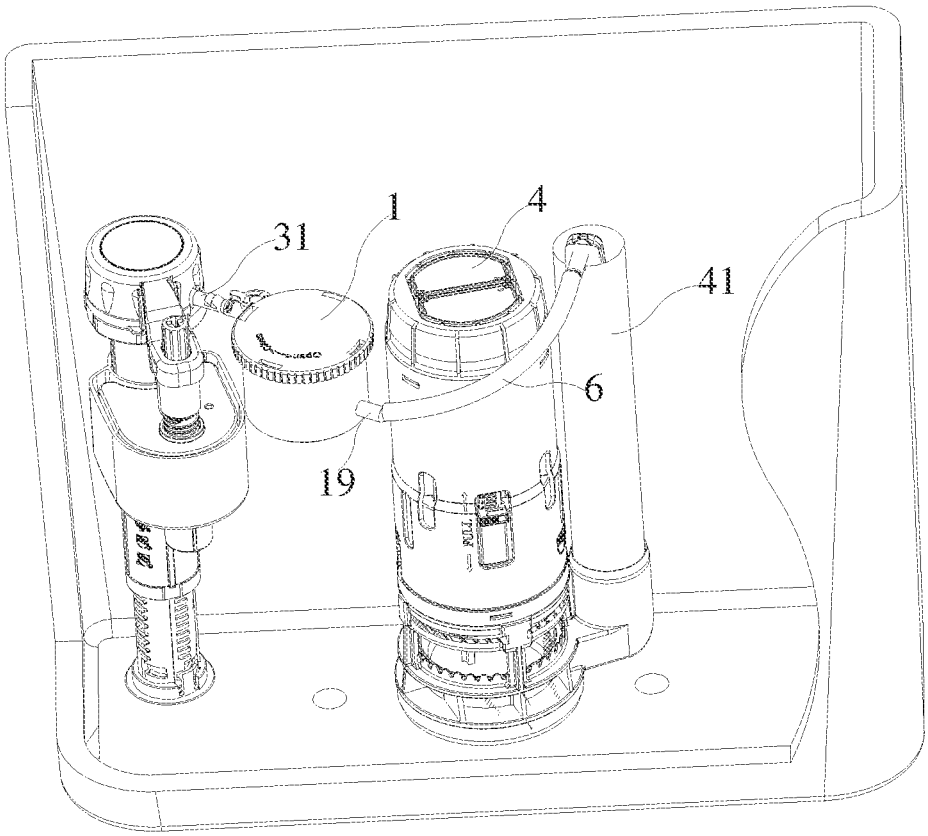
FIG. 16 is a schematic diagram of a structure of a dissolver body mounted on an overflow tube in Embodiment 3 of the present disclosure.
Figure 17:
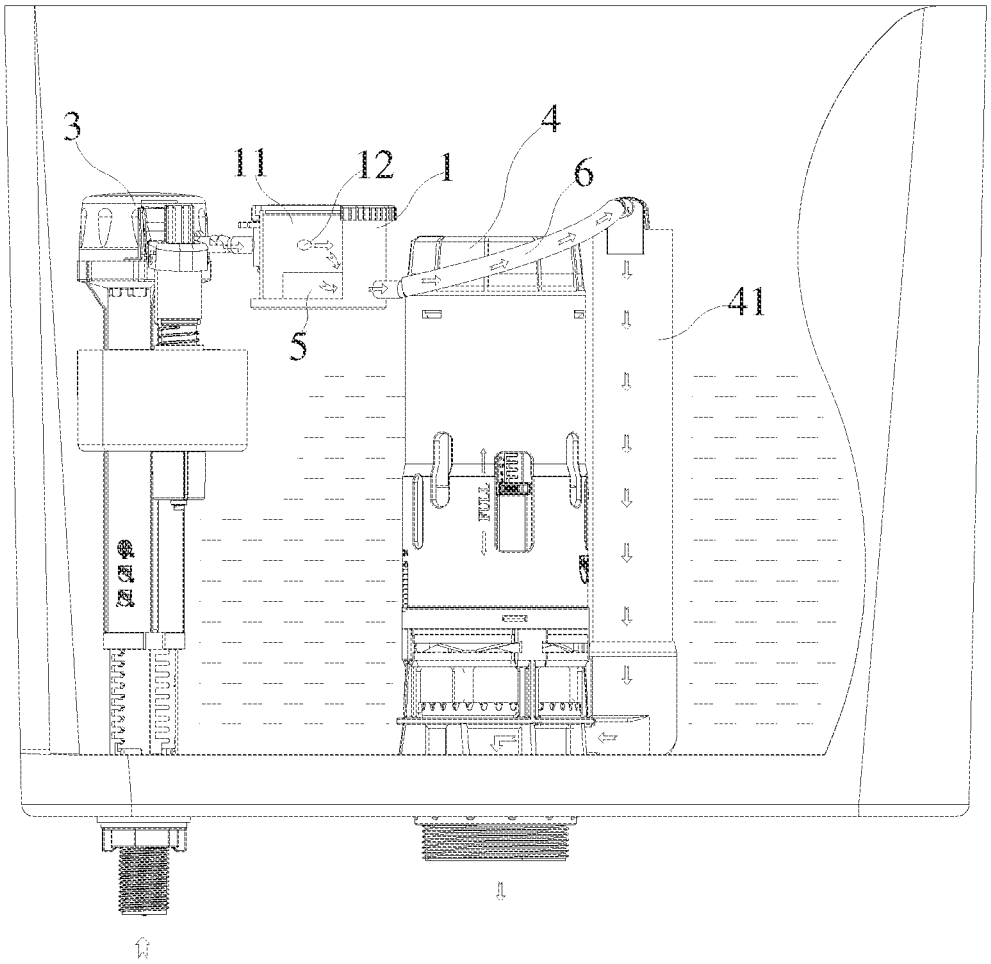
FIG. 17 is a schematic diagram of a flow path of a dissolver body mounted on an overflow tube in Embodiment 3 of the present disclosure.
Figure 18:
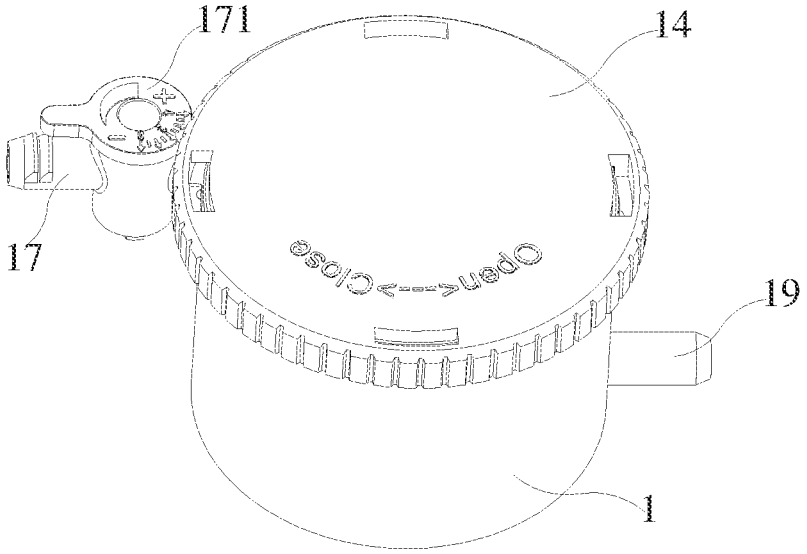
FIG. 18 is a three-dimensional view of a dissolver body in Embodiment 3 of the present disclosure.
Figure 19:
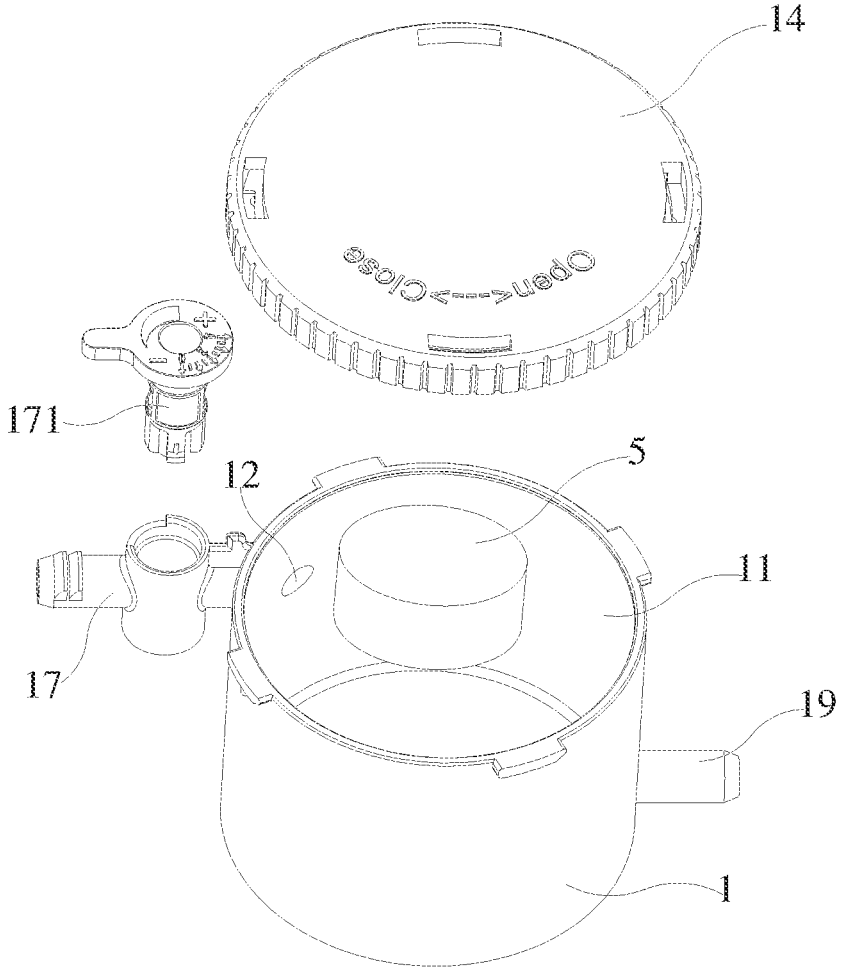
FIG. 19 is an exploded view of a dissolver body in Embodiment 3 of the present disclosure.

Emphatically referring to FIG. 14, a boss 112 is convexly arranged at a position, corresponding to the water outlet 13, of the bottom of the dissolving cavity 11; and a second water passing hole 113 communicating with the water outlet 13 is provided in a side wall of the boss 112. The water after the cleaning tablet 5 is dissolved may flow into the water outlet 13 from the second water passing hole 113 and then flow out from the water outlet 13. The cleaning tablet 5 is placed on the boss 112 capable of raising the cleaning tablet 5 without blocking the water outlet 13.

Embodiment 3

Emphatically referring to FIGS. 16 to 19, the water piece mounted with the dissolver body 1 in this embodiment is different from that in Embodiment 1, and the dissolver body 1 in this embodiment is arranged on the water inlet valve 3. Specifically, the water inlet 12 of the dissolver body 1 is directly inserted with the water replenishing tube 31 of the water inlet valve 3 to hang the dissolver body 1 at a top of the water inlet valve 3. Further, the dissolver body 1 is provided with the water inlet connector 17 at the water inlet 12, and the water inlet connector 17 is inserted and matched with the water replenishing tube 31 of the water inlet valve 3, such that the dissolver body 1 is hung on the water inlet valve 3, and the water inlet 12 is directly connected to the water replenishing tube 31 of the water inlet valve 3 through the water inlet connector 17. The pipeline 6 does not need to be arranged between the water inlet 12 and the water replenishing tube 31, and the water outlet 13 is connected to the overflow tube 41 through the pipeline 6. A water outlet connector 19 is preferably arranged at the water outlet 13 and facilitates the connection with the pipeline 6.

Furthermore, the water inlet 12 is provided in the side wall of the dissolver body 1, and the water outlet 13 may be provided in the bottom or the side wall of the dissolver body 1. However, when located in the side wall of the dissolver body 1, the water outlet 13 needs to be located below the water inlet 12 to prevent backflow. The water inlet 12 and the water outlet 13 are preferably provided in two sides of the dissolver body 1 respectively, such that the water inlet connector 17 and the water outlet connector 19 are on a straight line or parallel to each other, thereby reducing a length of the pipeline 6 between the water outlet connector 19 and the overflow tube 41.

In addition, in this embodiment, a water replenishing regulator 171 may be arranged on the water inlet connector 17 to regulate water flow for replenishing the water. If the water outlet 13 in this embodiment is provided in the bottom of the dissolver body 1, the boss 112 and the second water passing hole 113 may be arranged at the bottom of the dissolver cavity 11 as in Embodiment 2 to prevent the cleaning tablet 5 from blocking the water outlet 13.

The above descriptions are only preferred embodiments of the present disclosure, and are not limitations to the design of the present disclosure. Any equivalent changes made according to the design key points of the present disclosure fall within the scope of protection of the present disclosure.

The invention claimed is:

1. A dissolver for a cleaning tablet in a water tank of a toilet, comprising a dissolver body hung on an overflow tube of a water outlet valve inside the water tank of the toilet, wherein a dissolving cavity for storing and dissolving the cleaning tablet is arranged inside the dissolver body; the dissolver body is further provided with a water inlet and a water outlet which communicate with the dissolving cavity; the water inlet is connected to a water replenishing tube of a water inlet valve through a pipeline; the water outlet is in communication with the overflow tube of the water outlet valve; and when the water inlet valve replenishes water, the water in the water replenishing tube flows into the dissolving cavity from the water inlet to dissolve the cleaning tablet, and after the cleaning tablet is dissolved, the water flows into the overflow tube from the water outlet to replenish the water for the toilet; and wherein an arc-shaped groove matched with a side wall of the overflow tube is provided in a bottom of a side wall of the dissolver body; the dissolver body is hung at a top of the overflow tube through matching between the arc-shaped groove and the side wall of the overflow tube; the water outlet is provided in the side wall of the dissolver body and located above the arc-shaped groove; the dissolver body is provided with a water outlet channel extending downwards at the water outlet; and when the dissolver body is hung at the top of the overflow tube, the water outlet channel extends into the overflow tube.

2. The dissolver for the cleaning tablet in the water tank of the toilet according to claim 1, wherein a partition board is arranged inside the dissolving cavity of the dissolver body; one end of the partition board is integrally connected to a side wall of the dissolving cavity; a gap is reserved between a second end of the partition board and the side wall of the dissolving cavity; the water inlet and the water outlet are located on one side of the partition board; and the cleaning tablet is located on a second side of the partition board.

3. The dissolver for the cleaning tablet in the water tank of the toilet according to claim 1, wherein a water inlet connector is arranged at the water inlet of the dissolver body; and a water replenishing regulator is arranged on the water inlet connector and configured to regulate water flow entering the dissolving cavity.

4. The dissolver for the cleaning tablet in the water tank of the toilet according to claim 1, wherein an arc-shaped bulge is provided at a position, corresponding to the arc-shaped groove, of a bottom of the dissolving cavity; and the water outlet is located above the arc-shaped bulge.

5. The dissolver for the cleaning tablet in the water tank of the toilet according to claim 1, wherein a detachable cover is arranged at a top of the dissolver body.

6. A dissolver for a cleaning tablet in a water tank of a toilet, comprising a dissolver body hung on an overflow tube of a water outlet valve inside the water tank of the toilet, wherein a dissolving cavity for storing and dissolving the cleaning tablet is arranged inside the dissolver body; the dissolver body is further provided with a water inlet and a water outlet which communicate with the dissolving cavity; the water inlet is connected to a water replenishing tube of a water inlet valve through a pipeline; the water outlet is in communication with the overflow tube of the water outlet valve; and when the water inlet valve replenishes water, the water in the water replenishing tube flows into the dissolving cavity from the water inlet to dissolve the cleaning tablet, and after the cleaning tablet is dissolved, the water flows into the overflow tube from the water outlet to replenish the water for the toilet; and wherein a connecting sleeve is arranged at a bottom of the dissolver body and sleeved on the overflow tube.

7. The dissolver for the cleaning tablet in the water tank of the toilet according to claim 6, wherein a first water passing hole is provided in a top of the connecting sleeve; and the water outlet is provided in the bottom of the dissolver body and corresponds to the first water passing hole.

8. The dissolver for the cleaning tablet in the water tank of the toilet according to claim 7, wherein a boss is convexly arranged at a position, corresponding to the water outlet, of a bottom of the dissolving cavity; and a second water passing hole in communication with the water outlet is provided in a side wall of the boss.

9. The dissolver for the cleaning tablet in the water tank of the toilet according to claim 6, wherein a water inlet connector is arranged at the water inlet of the dissolver body; and a water replenishing regulator is arranged on the water inlet connector and configured to regulate water flow entering the dissolving cavity.

10. The dissolver for the cleaning tablet in the water tank of the toilet according to claim 6, wherein the connecting sleeve is eccentrically arranged at the bottom of the dissolver body.

11. The dissolver for the cleaning tablet in the water tank of the toilet according to claim 6, wherein the connecting sleeve is connected to the dissolver body through a plurality of supports.

12. The dissolver for the cleaning tablet in the water tank of the toilet according to claim 6, wherein a detachable cover is arranged at a top of the dissolver body.

13. A dissolver for a cleaning tablet in a water tank of a toilet, comprising a dissolver body arranged on a water inlet valve inside the water tank of the toilet, wherein a dissolving cavity for storing and dissolving the cleaning tablet is arranged inside the dissolver body; the dissolver body is further provided with a water inlet and a water outlet which communicate with the dissolving cavity; the water inlet is connected to a water replenishing tube of the water inlet valve; the water outlet is connected to an overflow tube of a water outlet valve; and when the water inlet valve replenishes water, the water in the water replenishing tube flows into the dissolving cavity from the water inlet to dissolve the cleaning tablet, and after the cleaning tablet is dissolved, the water flows into the overflow tube from the water outlet to replenish the water for the toilet; and wherein the water inlet is inserted with the water replenishing tube of the water inlet valve; and the water outlet is connected to the overflow tube through a pipeline.

14. The dissolver for the cleaning tablet in the water tank of the toilet according to claim 13, wherein the dissolver body is provided with a water inlet connector at the water inlet; and the water inlet connector is matched with the water replenishing tube of the water inlet valve in an inserted manner.

15. The dissolver for the cleaning tablet in the water tank of the toilet according to claim 14, wherein the water inlet connector connected to the water replenishing tube of the water inlet valve is arranged at the water inlet of the dissolver body; and a water replenishing regulator is arranged on the water inlet connector and configured to regulate water flow entering the dissolving cavity.

16. The dissolver for the cleaning tablet in the water tank of the toilet according to claim 13, wherein a detachable cover is arranged at a top of the dissolver body.

* * * * *